United States Patent [19]

Sickert et al.

[11] Patent Number: 4,809,524

[45] Date of Patent: Mar. 7, 1989

[54] MEANS FOR INLETTING WATER INTO AN AUTOMATIC WASHER INCLUDING A WATER INLET AND LOUVERED BASKET ARRANGEMENT

[75] Inventors: Richard G. Sickert, San Diego, Calif.; John W. Pielemeier, St. Joseph; Dale E. Mueller, Benton Harbor, both of Mich.

[73] Assignee: Whirlpool Corporation, Benton Harbor, Mich.

[21] Appl. No.: 868,606

[22] Filed: May 30, 1986

[51] Int. Cl.[4] ..... D06F 21/08; D06F 39/08

[52] U.S. Cl. ..... 68/148; 68/207

[58] Field of Search ..... 68/23.5, 53, 148, 151, 68/207

[56] References Cited

U.S. PATENT DOCUMENTS

| | | | |
|---|---|---|---|
| 2,201,685 | 5/1940 | Lorenzen | 68/148 |
| 2,264,202 | 11/1941 | Forney | 68/23.4 |
| 2,313,634 | 3/1943 | Forney | 68/207 X |
| 2,526,344 | 10/1950 | Geldhof et al. | 68/148 |
| 2,579,393 | 12/1951 | Modrey | 68/151 X |
| 2,816,429 | 12/1957 | Kurlancheek | 68/151 X |
| 3,324,688 | 6/1967 | Hubbard | 68/23.5 X |
| 3,722,234 | 3/1973 | Douglas | 68/23.5 |
| 4,000,968 | 1/1977 | Schrage et al. | 68/23.5 X |

FOREIGN PATENT DOCUMENTS

| | | | |
|---|---|---|---|
| 1057338 | 3/1954 | France | 68/23.5 |
| 4758 | of 1912 | United Kingdom | 68/148 |
| 573155 | 11/1945 | United Kingdom | 68/23.5 |

*Primary Examiner*—Philip R. Coe

[57] ABSTRACT

A water inlet for use in an automatic washing machine includes an inlet housing mounted to direct water downwardly between a washtub and a rotatable perforate basket during fill operations. A plurality of louvers project outwardly from a sidewall of the perforate basket so that, as the perforate basket is rotated, the louvers pass through the incoming stream of water to capture a portion thereof, and sling it inwardly to form a spray directed inwardly of the perforate basket during a spray rinse operation.

24 Claims, 2 Drawing Sheets

FIG. 5
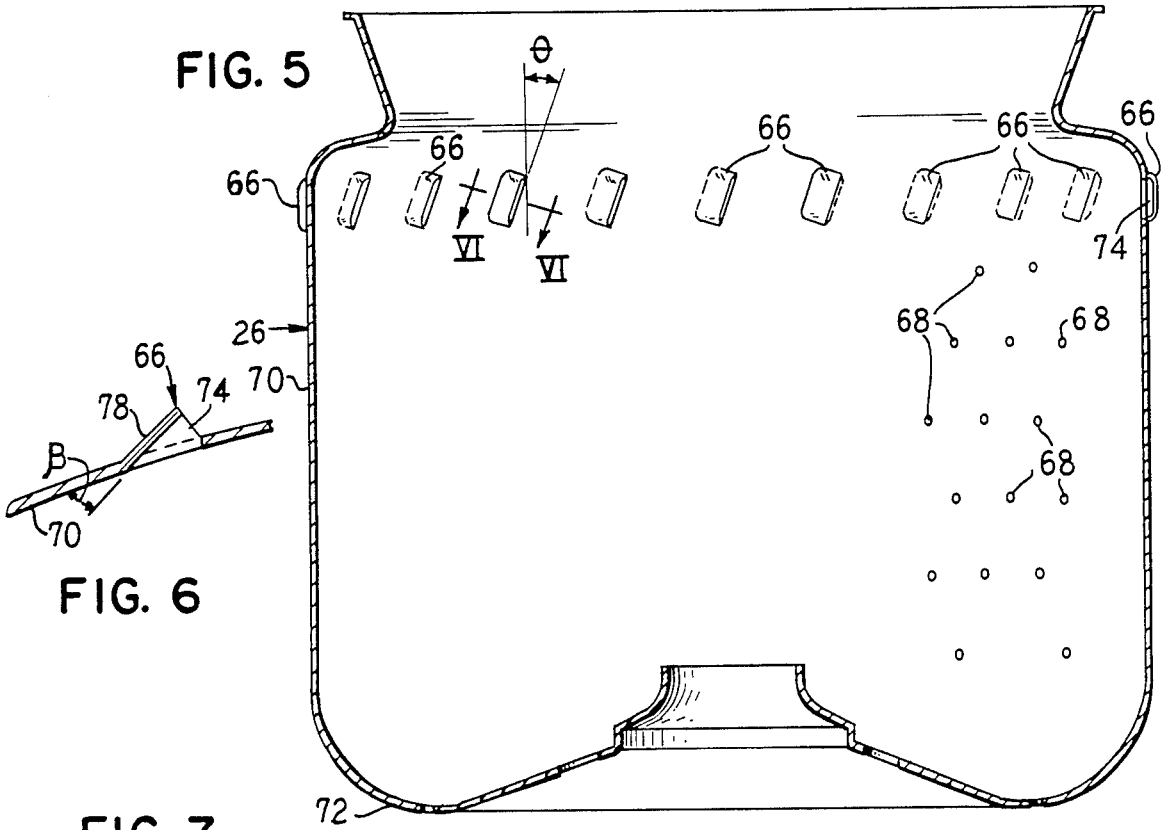
FIG. 6
FIG. 7
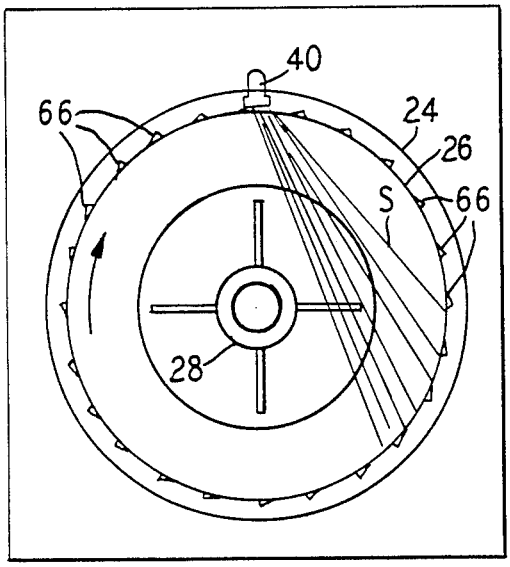
FIG. 8
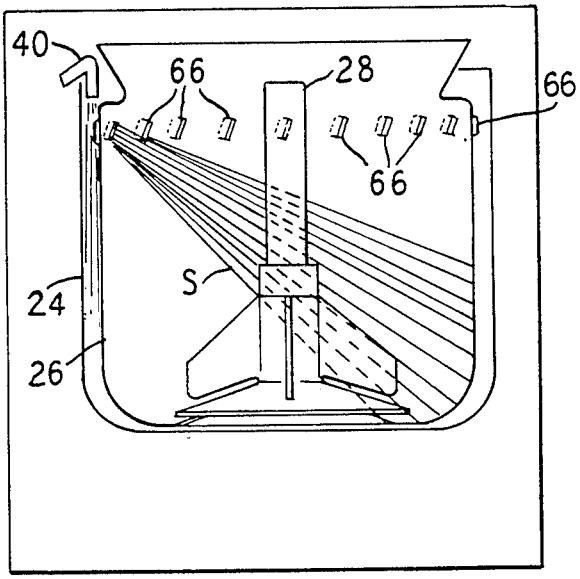

MEANS FOR INLETTING WATER INTO AN AUTOMATIC WASHER INCLUDING A WATER INLET AND LOUVERED BASKET ARRANGEMENT

BACKGROUND OF THE INVENTION

1. Field of the Invention

The present invention relates generally to an automatic clothes washing machine and more specifically, to a water inletting method and means.

2. Description of the Prior Art

Known automatic washers of the vertical axis agitator type generally include perforate baskets rotationally mounted within a washtub and a water inlet that directs a spray of water into the washtub for filling and toward a clothes load being spun or centrifuged during a rinse operation.

Slotted perforate baskets are also known. For example, in U.S. Pat. No. 3,324,688, an upper portion of main perforate basket is angled inwardly and includes a series of slots toward which water from a fill nozzle is directed. The slots break up the incoming stream of water into a spray during fill and spray rinse operations.

In U.S. Pat. No. 3,722,234, a water inlet is arranged intermediate the top and bottom of an outer tub to spray water between the inner and outer tubs and tangentially against the inner tub. Suds are broken down between the tubs and the inner tub is assisted in its rotation by the impact of the spray.

In U.S. Pat. No. 2,201,685, a rotatable cage includes a plurality of vertical slots in the lower sidewall. The metal struck to form these slots is bent slightly outwardly to form a series of curved lips at the forward edge of the slots with respect to the direction of rotation to cause water to flow outward through the cage wall.

U.S. Pat. No. 2,264,202 discloses a sidewall and bottom of a clothes bowl provided with a plurality of fins formed by lancing the sidewall and deforming the metal inwardly. The fins, which are of various shapes, agitate the water and clothes load during wash and rinse operations and also agitate the clothes during drying. No spray rinse operation is disclosed.

An automatic washer-dryer having inner and outer wash tubs is disclosed in U.S. Pat. No. 2,816,429, in which the lower sidewall of the outer tub includes a plurality of turbine buckets for capturing water directed thereagainst by a nozzle to cause the tub to spin. The turbine buckets do not distribute water within the tub.

In U.S. Pat. No. 2,526,344, a water inlet is shown for directing water against a curved upper flange portion of a basket wall having a series of holes as the basket is rotated during a spray rinse operation. Some of the water is atomized into a fine spray as it passes through the holes, while another portion splashes down the basket side and yet another portion splashes inward over the inwardly projecting basket lip.

French Pat. No. 1,057,338 discloses a series of cells 18 in an upper portion of the basket sidewall and inlet water 19 through which soap suds are withdrawn during rinse as water is introduced through a water discharge 7.

In the washers having forceful introduction of fill water, the water can deflect from clothes within the tub and splash from the washer and/or between the tub and washer cabinet onto the internal mechanisms within the washer.

SUMMARY OF THE INVENTION

The present invention provides a water inlet structure and method for use in an automatic washer which provides two types of water delivery in a single mechanism. A "soft" water delivery is provided during normal fill operations while the spin basket is stationary to prevent splashing of the fill water since it quiescently enter the basket through the basket perforations. During rinse operations when the spin basket is rotating, a forceful spray of incoming water is provided by using the inlet in conjunction with a louvered wall of the spin basket which functions as a pump.

The present invention is embodied in a water inlet housing which directs incoming water downwardly between a wash tub and a perforate basket rotatinally mounted with the tub. The perforate basket is provided with a plurality of outwardly directed vanes, or louvers, to capture and deflect incoming water into the basket as the basket rotates during a rinse cycle to form a forceful spray of water directed toward the clothes.

By directing the fill water downwardly between the basket wall and the tub wall, splashing of the fill water from the washtub and from the machine is eliminated and the chances of oversudsing of the detergent are reduced as well. Also, fill water entering the tub outside the basket forces the water to enter the basket through the clothes, tending to loosen the clothes pressed against the tub during a spinning operation and reduce the length of agitation time required to loosen the clothes and have them begin to float in the wash bath. During rinse portions of the wash cycle with the perforate basket rotating, incoming water being fed between the basket and tub rinses away suds, dirt, and floating waste, known as "scrud", from the region between the tub and basket thereby conditioning the machine so that the tub is clean for the next wash load.

A portion of the incoming water is captured by the vanes, or louvers, and, as the basket rotates, water is directed and forcefully impelled into the interior of the basket and against the clothes as a dynamic spray. The size, shape, angle and number of louvers on the basket determine the direction and intensity of the water spray. In a preferred embodiment, the louvers are arranged to direct a heavy spray toward the zone in the basket where clothes are found during spining.

Thus, the present device provides both a soft fill of wash water and a relatively strong rinse spray from a single inlet with the added advantage of purging suds from the washtub.

BRIEF DESCRIPTION OF THE DRAWINGS

FIG. 5 is a vertical cross section of a perforate basket of the present invention for use in the automatic washing machine shown in FIG. 1;

FIG. 6 is an enlarged cross section of an individual louver of the basket shown in FIG. 5;

FIG. 7 is a plan view of the washing machine of FIG. 1 showing the spray pattern of the present invention during a rinse operation; and FIG. 8 is a side elevation in cross section of the washing machine shown in FIG. 7 showing additional details of the spray rinse pattern.

DESCRIPTION OF THE PREFERRED EMBODIMENTS

Figure 1:
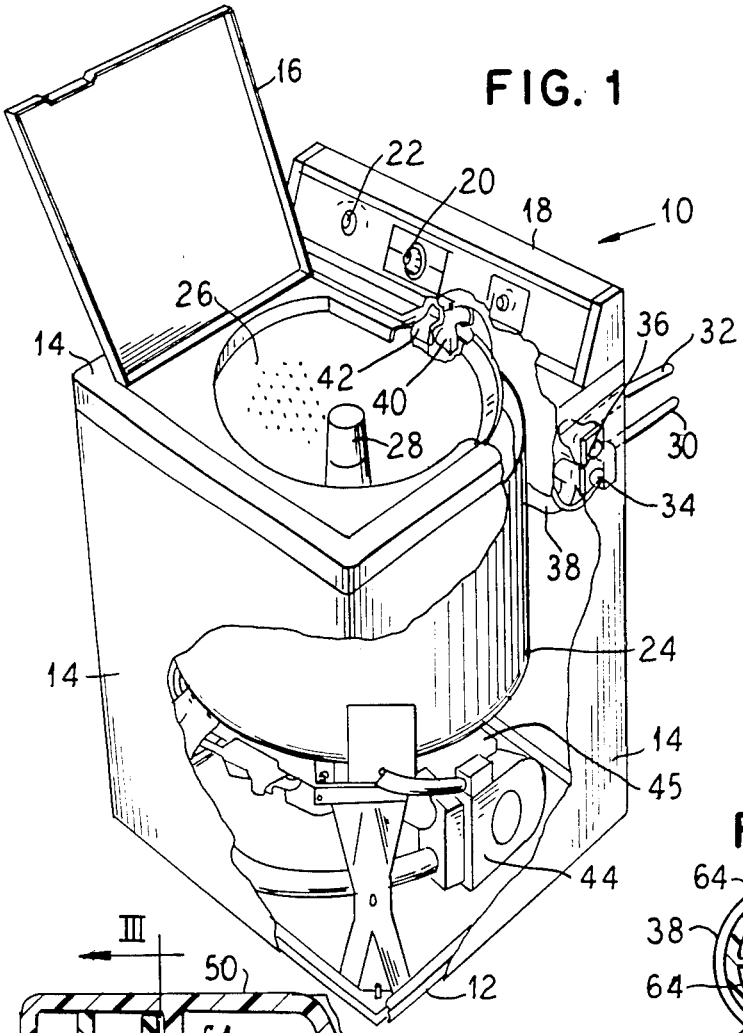
FIG. 1 is a perspective view, partially cut away, of an automatic washing machine including a water inlet arrangement embodying the structural principles of the present invention and capable of practicing the steps of the contemplated method.

In FIG. 1, reference numeral 10 indicates generally a vertical axis agitator type washing machine of the automatic type, i.e., a washer having a pre-settable control means for automatically operating the machine through a programmed series of washing, rinsing and drying steps. The machine includes a frame 12 carrying panels 14 forming the sides, top, front and back of a cabinet 15 for the washing machine 10. A hinged lid 16 is provided in the usual manner for access to the interior of the washing machine 10. The washing machine 10 has a rear console 18 in which is disposed the manual selector portions of the presettable control means including a timer dial 20 and a temperature selector 22.

Internally of the washing machine 10 there is disclosed an imperforate fluid containing tub 24 within which is rotatably mounted a perforate basket 26 for rotation about a vertical axis, as well as a vertically disposed agitator 28. Water is supplied to the imperforate tub 24 from a water supply through domestic hot and cold water supply lines 30 and 32, respectively, which are connected to respective hot and cold mixing valves 34 and 36. The mixing valves 34 and 36 are connected to a water fill conduit 38 (including a syphon break-not shown) which leads to a water inlet housing 40 mounted in a tub ring 42 at an upper edge of the imperforate tub 24. A pump 44 is mounted within the cabinet 15 for emptying water from the tub 24 and a motor 45 is connected to operate the pump 44 as well as the agitator 28 and to rotate the basket 26.

Figure 2:
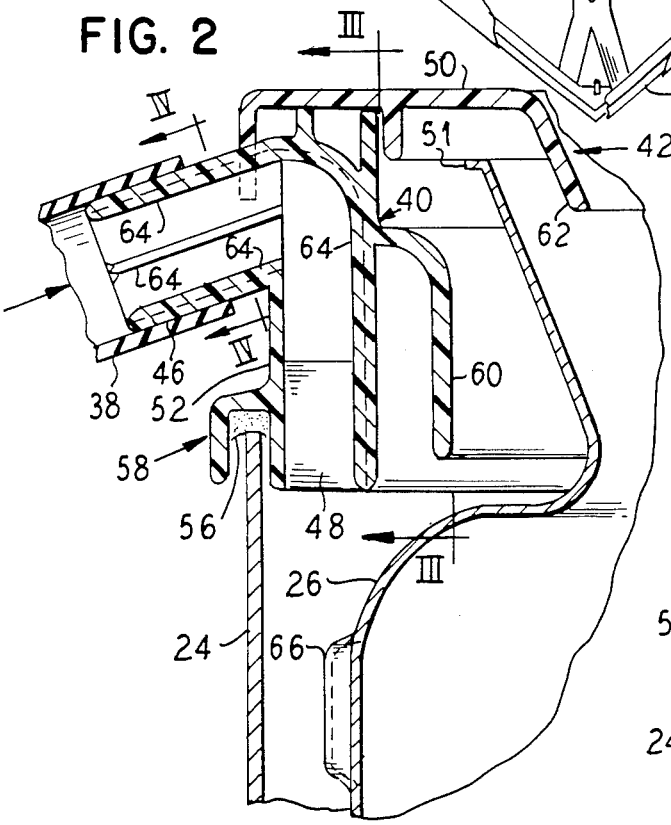
FIG. 2 is a vertical cross section of the water inlet shown in FIG. 1.

In FIG. 2, the water inlet housing 40 includes an outwardly directed connecting tube 46 over which the inlet hose 38 is affixed and a downwardly directed nozzle 48 from which incoming water flows. The inlet housing 40 is moulded integrally with the tub ring 42 in a lower support 52 which is heat sealed to an upper shield 50. The lower support 52 is mounted over a top edge 54 of the washtub 24 and, in the illustrated embodiment, includes a sealant 56 in an annular flange 58 for sealed engagement with the edge 54. An inner flange 60 is included to reduce any water flow that may attempt to move upward off the spinning basket 26. The upper shield 50, which is preferably unitarily connected to the lower support 52, includes an inner lip 62 to direct clothes into the interior of the basket 26 and shield the upper basket edge 51 from contact by a user's hand.

Figure 3:
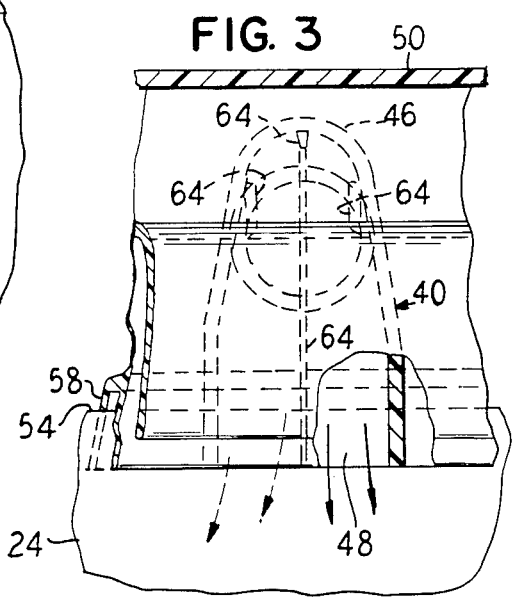
FIG. 3 is a cross section of the water inlet of FIG. 2 taken along lines III—III.

The connecting tube 46 is disposed at an angle to accommodate the inlet hose 38, which extends somewhat vertically for connection to the mixing valves 34 and 36. Water flows from the inlet hose 38 to the connecting tube 46 and is directed downward between the tub 24 and basket 26 by the nozzle 48. As shown in FIGS. 2 and 3, flow straightening fins 64 are included in the connecting tube 46 and nozzle 48 to reduce the turbulence of the inflowing water.

In accordance with this invention, the rotatable basket 26 includes a plurality of vanes, or louvers, 66 projecting outwardly therefrom beneath the water nozzle 48 into an intercepting relation with the stream of water ejected from the nozzle 48. Thus, as water flows therefrom, a portion thereof is captured or engaged by the louvers 66 as the basket 26 rotates.

Referring to FIG. 3, the inlet housing 40 is shown including the connecting tube 46 and the water nozzle 48. The nozzle 48 is elongated in a direction tangential to the basket 26 sidewall to reduce the incoming water velocity and so that incoming water flows downwardly along a larger segment of the basket 26 and tub 24.

Figure 4:
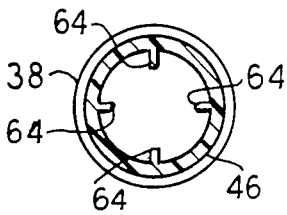
FIG. 4 is a cross section of the water inlet shown in FIG. 2 taken along lines IV—IV.

Referring to the cross sectional view of FIG. 4, the flow straightening fins 64 are disposed in circumferentially spaced relation at the quadrants of the cylindrical tube 46 so that turbulence, which may have been generated in the inflowing water by the mixing valves 34 and 36, is reduced to provide a more even water flow into the tub 24. The reduced turbulence also insures that the stream of water is relatively uniform as it flows past the louvers 66.

Referring now to FIG. 5, the perforate basket 26 has a plurality of perforations 68 extending through a side wall 70 and a bottom wall 72. Water passes through the perforations 68 and into the basket 26 during fill operations, and passes through the perforations 68 and out of the basket 26 during draining and rinse operations. The louvers of 66 are spaced evenly in a circumferential row or band below the top edge of the side wall 70 of the perforate basket 26. Each of the louvers 66 is formed to be disposed at an angle $\theta$ to the axis of rotation of the basket 26 with a scoop-shaped open side 74 facing in the direction of basket rotation during a spin portion of a wash cycle. We have found that when the louvers 66 are oriented with angle $\theta$ at approximately 15° with respect to the rotational axis of the basket 26, water caught by the louvers 66 during rotation will be directed or impelled forcefully downward during the spray rinse operation. The louvers 66 may be formed in the basket sidewall 70 by punching and drawing so that the louvers 66 extend outward from the side wall 70 to form the cup-shaped openings 74.

In FIG. 6, details of an individual louver 66 are shown in cross section including an angular wall 78 extending from the basket sidewall 70. Water from the nozzle 48 will be impelled and redirected in a forceful spray rinse in a predetermined pattern. The angle $\beta$ of the angular wall 78 from the sidewall 70, in conjunction with the rotational speed of the basket 26, determines the horizontal angle of the spray, while the angle $\theta$ of the louver 66 determines the vertical angle of the spray.

In FIGS. 7 and 8, a spray pattern "S" is shown as created by the angle $\beta$ as the louvers 66 on the rotating basket 26 move past the inflowing water coming from the inlet 40. Since the basket 26 rotates in a clockwise direction as viewed in FIG. 7 the spray S is directed toward an opposite side of the basket 26 laterally of the agitator 28.

The angle $\theta$ of the louvers 66 causes the water spray S to be directed downwardly to a lower portion of the basket sidewall 70 as shown in FIG. 8. Clothes generally lie in the lower portion of the basket sidewall 70 during the spin operation. Thus, the spray pattern S is configured and directionalized in a most efficient manner directly toward the mass of clothes to be rinsed during spinning. The spray pattern S generated by the rotating louvers 66 has considerable force and is most effective in removing detergent residue from the clothes.

Only a portion of the water flowing through the inlet housing 40 is captured by, or intercepted by, the passing louvers 66 during a typical spin operation. The remainder of the water flows between the basket 26 and the tub 24 where it rinses suds and dirt from this region thereby conditioning the machine so that subsequent wash operations are begun with a clean washtub 24 and basket 26.

It will be understood that the spray pattern S of the rinse water can be varied by changing the size, shape and wall angle $\beta$ of the louvers 66, as well as their angular orientation $\theta$ with respect to the basket rotational axis. The number and size of the louvers 66 in the basket sidewall 70 can also be varied to capture more or less of the incoming water for forming the spray pattern S. It is also contemplated that curved louvers, or vanes, could be used as well as a mixture of louver sizes, orientations, and shapes on a single basket to generate, for example, a broader or narrower spray pattern or a bifurcated spray pattern.

In summary, the automatic laundry machine of the present invention utilizes a perforate spin basket in a tub, thereby to form a treatment zone in which a vertical axis agitator is driven.

By confining a pressurized supply of temperature conditioned water in the form of a stream, the stream is directed exteriorly of the treatment zone so that filling of the zone will occur quiescently through the perforations of the spin basket.

By using the spin basket as a pump in conjunction with said stream, impeller vanes are provided in the wall of the basket constructed and arranged to intercept the stream and forcefully impel water in a directionalized spray pattern downwardly and interiorly towards the clothes spinning in the basket.

The present invention provides a single water inlet 40 which provides a soft fill for washing that prevents water from splashing into water sensitive areas of the washing machine 10, such as the console 18 or motor 45 while the spin basket is stationary. Additionally, the inlet of the invention prevents the fill water from splashing from the machine and onto a user of the present device, such as may occur when incoming water ricochets off of some article of laundry. The same water inlet 40 is also used in conjunction with a rotating louvered basket operable as a pump to generate a forceful directionalized rinse spray S for engaging the clothes load during spray rinse operations. Simultaneously, soap and film is rinsed from the region between the basket 26 and tub 24 to provide a clean washing environment for the next washing cycle.

Although various alterations and modifications might be suggested by those skilled in the art, it should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic laundry machine of the type having a vertical axis perforate rotatable spin basket disposed in a tub, said basket having a perforate outer wall and forming a treatment zone within the outer wall, the improvement comprising:

nozzle means forming an inletting stream directed into the tub exteriorly of the outer wall of the basket said nozzle means being directed so that the inletting stream quiescently fills the basket through basket perforations when the basket is stationary; and impeller vane means formed in said perforate basket wall constructed and arranged to intercept the stream and operable therewith as a pump when the spin basket is rotating to direct a jet spray pattern into the treatment zone for power rinsing of the contents.

2. A perforate basket for use in an automatic washing machine having a vertically disposed agitator, a spray rinse cycle and a nozzle means forming an inlet stream exteriorly of the basket during the spray rinse cycle, said basket comprising:

a substantially cylindrical sidewall;

a plurality of perforations formed through said sidewall;

a bottom wall connected at a first end of said cylindrical sidewall;

a centrally disposed opening formed in said bottom wall for rotational mounting at the agitator;

a plurality of drain openings formed in said bottom wall; and a plurality of louvers formed in said cylindrical sidewall spaced from said bottom wall, each of said plurality of louvers projecting outwardly from said sidewall and including a capture opening directed substantially in a first rotational direction to intercept the stream and to capture water as said basket rotates in the first rotational direction to act as a pump to direct a spray of water inwardly of said basket during the spray rinse cycle for power rinsing of the contents.

3. A perforate basket as claimed in claim 2, wherein said plurality of louvers each include angular walls projecting outwardly from said cylindrical sidewall.

4. A perforate basket as claimed in claim 2, wherein each of said plurality of louvers is oriented at approximately 15° with respect to a rotational axis of said basket.

5. A perforate basket as claimed in claim 2, wherein said plurality of louvers form a uniformly spaced band of louvers substantially adjacent a second opposite end of said cylindrical sidewall.

6. A water inlet apparatus for use in an automatic washing machine having a washtub and a perforate basket tub rotationally mounted substantially concentrically within said washtub and an agitator centrally mounted within said washtub and said perforate basket, a motor operable to rotationally drive said perforate basket in a first rotational direction, comprising:

an inlet housing mounted adjacent a top edge of said washtub and including an inlet nozzle mounted to direct inflowing water between said washtub and said perforate basket;

a plurality of vanes formed extending ouwardly from said perforate basket spaced from the bottom of said perforate basket, and ones of said plurality of vanes having shaped open sides directed toward said first rotational direction, said open sides encountering a stream of inflowing water from said inlet nozzle as said perforate basket is driven in said first rotational direction by said motor; and at least one opening extending through said perforate basket at each of said plurality of vanes, said plurality of vanes acting as a water pump to direct at least a portion of the inflowing water through said at least one opening into the interior of said perforate basket as a spray as said perforate basket is rotated.

7. A water inlet apparatus as claimed in claim 6, wherein said plurality of vanes each have a deflecting wall disposed angularly with respect to a sidewall of the perforate basket to direct water encountered by said vanes into the perforate basket.

8. A water inlet apparatus for use in an automatic washing maching having a washtub and a perforate basket rotationally mounted substantially concentrically within said washtub and an agitator centrally mounted within said washtub and said perforate basket, comprising:

an inlet housing mounted adjacent a top edge of said washtub and including an inlet nozzle mounted to direct inflowing water between said washtub and said perforate basket;

a plurality of vanes formed extending outwardly from said perforate basket spaced from the bottom of said perforate basket, and ones of said plurality of vanes encountering a stream of inflowing water from said inlet nozzle as said perforate basket rotates;

at least one opening extending through said perforate basket at each of said plurality of vanes, said plurality of vanes directing at least a portion of the inflowing water through said at least one opening into the interior of said perforate basket as said perforate basket rotates; and flow straightening means in said inlet housing for reducing turbulence in inflowing water.

9. A water inlet apparatus for use in an automatic washing machine having a washtub and a perforate basket rotationally mounted substantially concentrically within said washtub and an agitator centrally mounted within said washtub and said perforate basket, comprising:

an inlet housing mounted adjacent a top edge of said washtub and including an inlet nozzle mounted to direct inflowing water between said washtub and said perforate basket;

a plurality of vanes formed extending outwardly from said perforate basket spaced from the bottom of said perforate basket, and ones of said plurality of vanes encountering a stream of inflowing water from said inlet nozzle as said perforate basket rotates;

at least one opening extending through said perforate basket at each of said plurality of vanes, said plurality of vanes directing at least a portion of the inflowing water through said at least one opening into the interior of said perforate basket as said perforate basket rotates; and said plurality of vanes being arranged at an angle to a rotational axis of said perforate basket to generate a downwardly angled rinse spray.

10. A water inlet apparatus for use in an automatic washing machine having a washtub and a perforate basket rotationally mounted substantially concentrically within said washtub and an agitator centrally mounted within said washtub and said perforate basket, comprising:

an inlet housing mounted adjacent a top edge of said washtub and including an inlet nozzle mounted to direct inflowing water between said washtub and said perforate basket;

a plurality of vanes formed extending from said perforate spaced from the bottom of said perforate basket, and ones of said plurality of vanes encountering a stream of inflowing water from said inlet nozzle as said perforate basket rotates;

at least one opening extending through said perforate basket at each of said plurality of vanes, said plurality of vanes directing at least a portion of the inflowing water through said at least one opening into the interior of said perforate basket as said perforate basket rotates; and a tub ring mounted adjacent a top edge of said washtub, said inlet housing being mounted in said tub ring.

11. An automatic washing machine having a wash cycle and a spray rinse cycle for cleaning laundry, comprising:

a cabinet;

a fluid containing wash tub mounted within said cabinet;

a perforate basket rotationally mounted concentrically within said washtub;

an agitator mounted substantially centrally within said perforate basket;

means for rotating said perforate basket in a first rotational direction, said rotating means driving said agitator;

an annular tub ring mounted adjacent a top rim of said wash tub;

a water fill conduit within said cabinet and connectable to a water supply;

a water inlet housing mounted in said tub ring and connected in fluid communication with said water fill conduit, said water inlet housing including a nozzle formed to direct a stream of water between said wash tub and said perforate basket; and a plurality of louvers formed in said perforate basket and each having an open side facing substantially toward said first rotational direction, said plurality of louvers extending outwardly from said perforate basket and into the stream of water directed by said nozzle as said perforate basket rotates, said plurality of louvers being shaped to capture at least a portion of the stream of water and direct the captured portion into the interior of said basket as said basket rotates in the first rotational direction to form a water spray.

12. An automatic washer as claimed in claim 11, wherein said plurality of louvers are shaped to direct the water spray toward a lower inner wall of said perforate basket.

13. An automatic washer as claimed in claim 11, further comprising:

means for straightening the flow of water through said inlet housing.

14. An automatic washer as claimed in claim 11, wherein said plurality of louvers are spaced uniformly in a band around said perforate basket, said band being spaced from a bottom of said basket by a greater distance than from a top of said basket.

15. An automatic washing machine having a wash cycle and a spray rinse cycle for cleaning laundry, comprising:

a fluid containing tub;

a perforate basket rotationally mounted within said tub;

an agitator mounted substantially centrally within said perforate basket;

means for rotatably driving said perforate basket in a first rotational direction, said rotating means driving said agitator;

a water inlet housing connectable to a water supply, said water inlet housing including a nozzle formed to direct a stream of water between said tub and said perforate basket; and a plurality of louvers formed in said perforate basket and shaped to form open sides facing said first rotational direction, said open sides causing said louvers to capture at least a portion of the stream of water and to direct the captured portion into the interior of said basket as said basket is rotatably in the first rotational direction by said means for rotatably driving.

16. An automatic washing machine as claimed in claim 15, further comprising:

a top rim formed on said tub, said water inlet housing being formed adjacent said top rim.

17. An automatic washing machine having a wash cycle and a spray rinse cycle for cleaning laundry, comprising:

a fluid containing tub;

a perforate basket rotationally mounted within said tub;

an agitator mounted substantially centrally within said perforate basket;

means for rotating said perforate basket in a first rotational direction, said rotating means driving said agitator;

a water inlet housing connectable to a water supply, said water inlet housing including a nozzle formed to direct a stream of water between said tub and said perforate basket;

a plurality of louvers formed in said perforate basket and shaped to capture at least a portion of the stream of water and to direct the captured portion into the interior of said basket as said basket rotates in the first rotational direction;

a top rim formed on said tub, said water inlet housing being formed adjacent said top rim; and an annular tub ring mounted adjacent said top rim, said water inlet housing being mounted to said tub ring.

18. An automatic washing washing as claimed in claim 15, wherein each of said plurality of louvers has an open side facing substantially toward said first rotational direction, said plurality of louvers extending outwardly from said perforate basket into the stream of water directed by said nozzle as said perforate basket rotates.

19. An automatic washing machine having a wash cycle and a spray rinse cycle for cleaning laundry, comprising:

a fluid containing tub;

a perforate basket rotationally mounted within said tub;

an agitator mounted substantially centrally within said perforate basket;

means for rotating said perforate basket in a first rotational direction, said rotating means driving said agitator;

a water inlet housing connectable to a water supply, said water inlet housing including a nozzle formed to direct a stream of water between said tub and said perforate basket;

a plurality of louvers formed in said perforate basket and shaped to capture at least a portion of the stream of water and to direct the captured portion into the interior of said basket as said basket rotates in the first rotational direction; and each of said plurality of louvers having an open side facing substantially toward said first rotational direction, said plurality of louvers extending outwardly from said perforate basket into the stream of water directed by said nozzle as said perforate basket rotates, said plurality of louvers being shaped to direct the water spray toward a lower inner wall of said perforate basket.

20. An automatic washing machine as claimed in claim 19, wherein said plurality of louvers are spaced uniformly in a band around said perforate basket, said band being spaced from a bottom of said basket by a greater distance than from a top of said basket.

21. An automatic washing machine as claimed in claim 19, wherein said plurality of louvers are spaced uniformly in a band around said perforate basket, said band being spaced from a bottom of said basket by a greater distance than from a top of said basket.

22. An automatic washing machine as claimed in claim 19, further comprising:

means for straightening the flow of water through said inlet housing.

23. An automatic washing machine having a wash cycle and a spray rinse cycle for cleaning laundry, comprising:

a fluid containing tub;

a perforate basket rotationally mounted within said tub;

an agitator mounted substantially centrally within said perforate basket;

means for rotating said perforate basket in a first rotational direction, said rotating means driving said agitator;

a water inlet housing connectable to a water supply, said water inlet housing including a nozzle formed to direct a stream of water between said tub and said perforate basket;

a plurality of louvers formed in said perforate basket and shaped to capture at least a portion of the stream of water and to direct the captured portion into the interior of said basket as said basket rotates in the first rotational direction;

means for straightening the flow of water through said inlet housing.

24. An automatic washing machine as claimed in claim 23, said plurality of louvers are spaced uniformly in a band around said perforate basket, said band being spaced from a bottom of said basket by a greater distance than from a top of said basket.

* * * * *